United States Patent [19]

Moebus

[11] 4,356,800

[45] Nov. 2, 1982

[54] LIQUID-COOLED, COMPOSITE PISTON FOR INTERNAL-COMBUSTION ENGINES

[75] Inventor: Horst Moebus, Neckarsulm, Fed. Rep. of Germany

[73] Assignee: Karl Schmidt GmbH, Neckarsulm, Fed. Rep. of Germany

[21] Appl. No.: 57,789

[22] Filed: Jul. 16, 1979

[30] Foreign Application Priority Data

Jul. 27, 1978 [DE] Fed. Rep. of Germany ..... 2832970

[51] Int. Cl.[3] ..... F02F 3/22

[52] U.S. Cl. ..... 123/193 P; 123/41.35; 92/216; 92/222

[58] Field of Search ..... 123/193 P, 193 R, 41.35, 123/41.37; 92/216, 222, 224, 225, 223

[56] References Cited

U.S. PATENT DOCUMENTS

| | | | |
|---|---|---|---|
| 1,539,882 | 6/1925 | Spencer | 92/224 |
| 2,524,273 | 10/1950 | Saler | 92/216 |
| 2,715,052 | 8/1955 | Jardine | 92/222 |
| 3,240,193 | 3/1966 | Ephraim, Jr. et al. | 123/41.35 |
| 3,385,175 | 5/1968 | Meier et al. | 123/41.35 |
| 3,402,644 | 9/1968 | Geiger et al. | 92/224 |
| 4,175,502 | 11/1979 | Moebus | 123/193 P |
| 4,205,649 | 6/1980 | Ostermann et al. | 123/193 P |

FOREIGN PATENT DOCUMENTS

| | | | |
|---|---|---|---|
| 800350 | 10/1950 | Fed. Rep. of Germany | 123/41.35 |
| 1055295 | 4/1959 | Fed. Rep. of Germany | 123/41.35 |
| 52-34114 | 3/1977 | Japan | 123/193 P |
| 1237238 | 6/1971 | United Kingdom | 92/222 |

*Primary Examiner*—Charles J. Myhre
*Assistant Examiner*—Andrew M. Dolinar
*Attorney, Agent, or Firm*—Sprung, Horn, Kramer & Woods

[57] ABSTRACT

In a liquid-cooled, composite piston for internal-combustion engines, particularly for medium-speed diesel engines, comprising a lower part, which made of a material comprising an eutectic aluminum-silicon alloy which lower part is connected to an upper part comprised of a ferrous material, said upper part formed on its underside with a concentric top rib, which rib forces the opposite bearing surface of the lower part and is so arranged that the rib constitutes the radially inner boundary of an annular cooling channel, which is disposed in the upper part behind the top land of the piston and behind at least part of the ring-carrying portion of the piston said rib also defining a central cooling chamber, which is disposed in the upper part and which communicates with the cooling channel by radial coolant bores, the improvement comprising a ring comprised of a ferrous material concentrically disposed and gripped between the bearing surface of the bearing rib and the opposite bearing surface of the lower part of the piston in an arrangement in which the confronting bearing surfaces of the bearing rib and the gripped ring are in peripheral rolling contact with one another.

9 Claims, 4 Drawing Figures

LIQUID-COOLED, COMPOSITE PISTON FOR INTERNAL-COMBUSTION ENGINES

BACKGROUND OF THE INVENTION

1. Field of the Invention

This invention relates to a liquid-cooled, composite piston for internal-combustion engines, particularly for medium-speed diesel engines, comprising a lower part, comprised of a eutectic aluminum-silicon alloy and is connected, e.g., by screws, to an upper part consisting of ferrous material, wherein the upper part is formed on its underside with a concentric bearing rib, which bears on the opposite bearing surface of the lower part and is so arranged that the rib constitutes the radially inner boundary of the annular cooling channel, which is disposed in the upper part behind the top land and behind at least part of the ring-carrying portion, and the rib also defines a central cooling chamber, which is disposed in the upper part and which communicates with the cooling channel by radial coolant bores. The cooling chambers or channels can be open to the interfacial plane.

2. Discussion of the Prior Art

Such two-part pistons are indispensable for high and very high loads. They may be made in various combinations. The head of the piston may be comprised of cast or forged steel or of nodular cast iron having strength properties similar to those of steel. The lower part of the piston consisting of the skirt and the piston pin boss may consist of a cast or forged aluminum piston alloy. The two parts are interconnected by tie rods or screws. All such two-part pistons must be cooled, preferably by a cooling oil.

Since the advent of two-part pistons having an upper part of steel or nodular cast iron and a lower part made from an aluminum piston alloy, wear has been observed between the upper and lower parts of the piston on the surface at which the bearing rib bears on the lower part of the piston. That wear has occurred particularly in the outer portion of the bearing surface and around the clamping screws and is due to radial and axial movements of the bearing surfaces of the two piston parts, which surfaces contact each other in the interfacial plane. These movements are caused by the warping action caused by the deformation of the upper part of the piston owing to the temperature and gas pressure and result not only in wear but involve also the risk of a plastic deformation of the lower part of the piston with a subsequent cracking and a shearing of material. Additionally, the plastic deformation causes the two parts of the piston to approach each other so that the tension of the screws or tie rods is reduced.

It is an object of the invention to provide a piston such that appreciable wear and/or a deformation adjacent to the bearing surface of the lower part of the piston is avoided even after a relatively long running time of the piston.

SUMMARY OF THE INVENTION

This object is accomplished by a ring, which comprises a ferrous material and is concentrically gripped between the bearing surface of the bearing rib and the opposite bearing surface of the lower part of the piston in an arrangement in which the confronting bearing surfaces of the bearing rib and the gripped ring are in peripheral rolling contact with one another.

As a result thereof, the movements caused by the temperature and gas pressure take place in the interfacial plane which is defined by the bearing rib and the gripped ring so that wear and deformation cannot be caused at the bearing surface of the lower part of the piston, which lower part consists of an aluminum piston alloy.

A preferred additional feature of the invention resides in that one of the two confronting bearing surfaces is arcuately curved outwardly, e.g., convexed and particularly crowned or shaped like a segment of a circle.

The bearing surface which faces the outwardly curved bearing surface of the gripped ring or bearing rib has preferably a corresponding concavity.

The curvatures of the two bearing surfaces may differ in size so that additional areas become effective as effective bearing surface areas as the load increases and the rise of the pressure per unit of area can thus be controlled.

As an additional measure to increase the wear resistance, one or both of the confronting bearing surfaces of the bearing rib and gripped ring may be hardened, chromium-plated, nitrided or surface-treated by other methods.

To center the gripped ring, it is either inserted in a concentric turned recess in the lower part of the piston or is provided at its inner or outer, lower edge with a peripheral annular centering nose, which engages a concentric turned recess in the lower part of the piston. The gripped ring may be rectangular, trapezoidal or the like in its essential cross-section. In addition, its axial side faces can be concave.

BRIEF DESCRIPTION OF DRAWINGS

Referring to the drawings herein.

DESCRIPTION OF SPECIFIC EMBODIMENTS OF THE INVENTION

Figure 1:
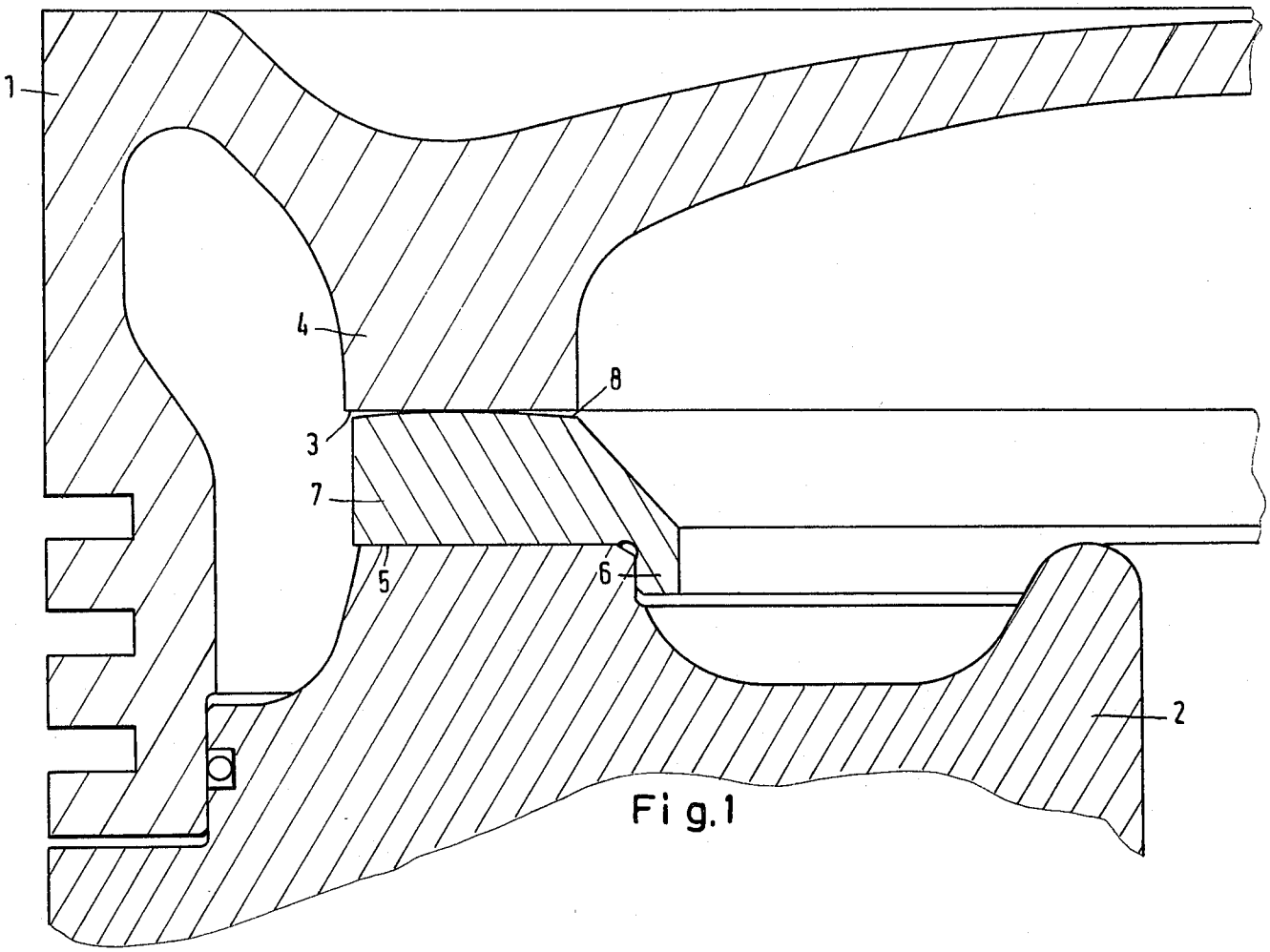
FIG. 1 is a fragmentary longitudinal sectional view showing the upper portion of a piston of the invention.

This invention will be shown by way of example in the drawings, which will now be explained.

Figure 2:
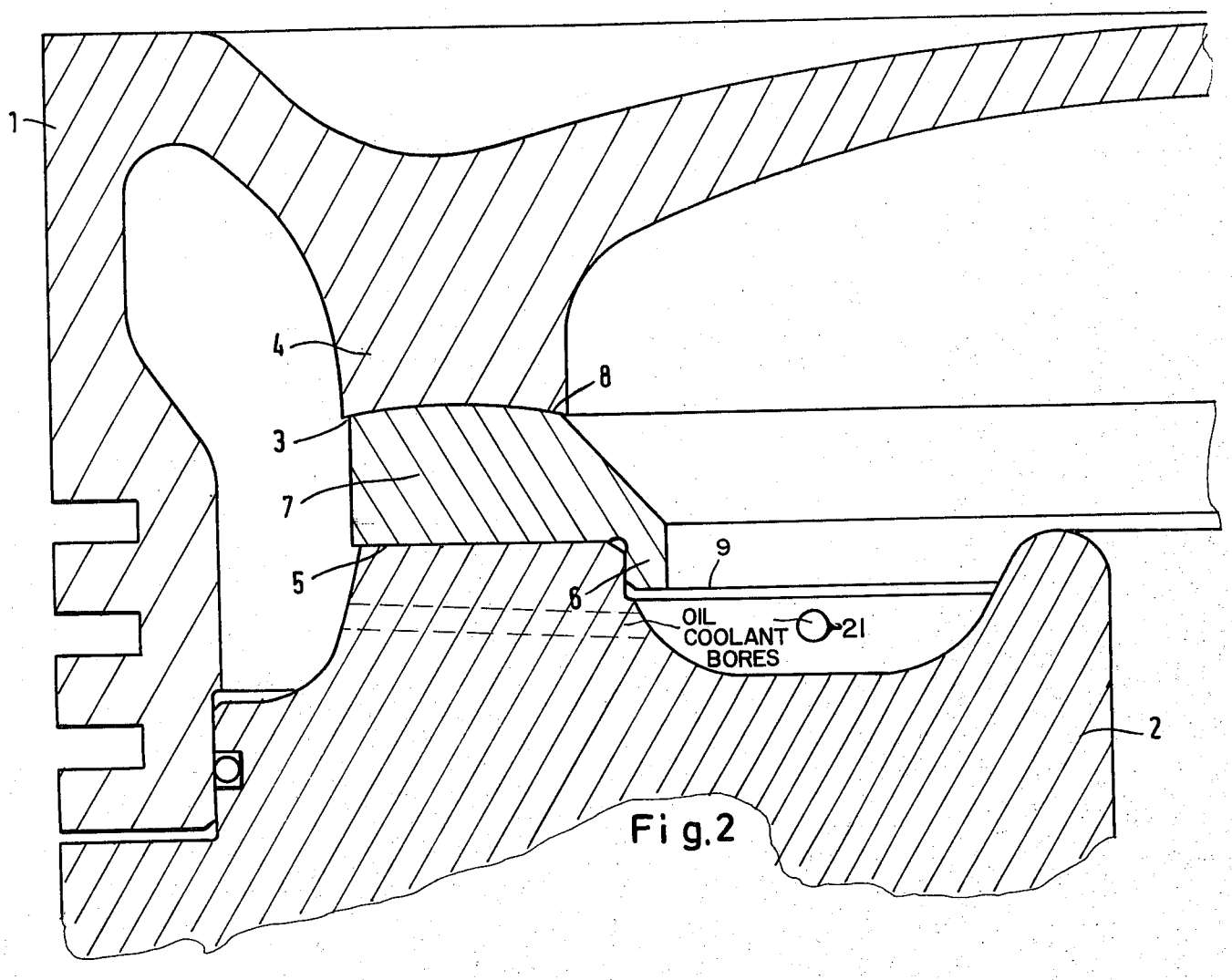
FIG. 2 is a view similar to FIG. 1 showing engagement of a gripped ring between opposed bearing surfaces.

FIG. 1 is a fragmentary longitudinal sectional view showing the upper portion of a piston, which consists of an upper part 1 of steel and a lower part 2 made from an aluminum piston alloy. A trapezoidal ring 7 is gripped between the planoparallel bearing surfaces 3 and 5 of the bearing rib 4 and the lower part 2, respectively, and is concentrically inserted in that a centering nose 6 provided at the lower inside edge of the ring is engaged with the turned recess 9 (FIG. 2). The bearing surface 8 with which the steel ring 7 faces the bearing surface 3 is crowned. This piston may be modified in that the bearing surface 3 with which the bearing rib 4 faces the crowned bearing surface 8 has a concavity which conforms to the convex curvature (FIG. 2).

Figure 3:
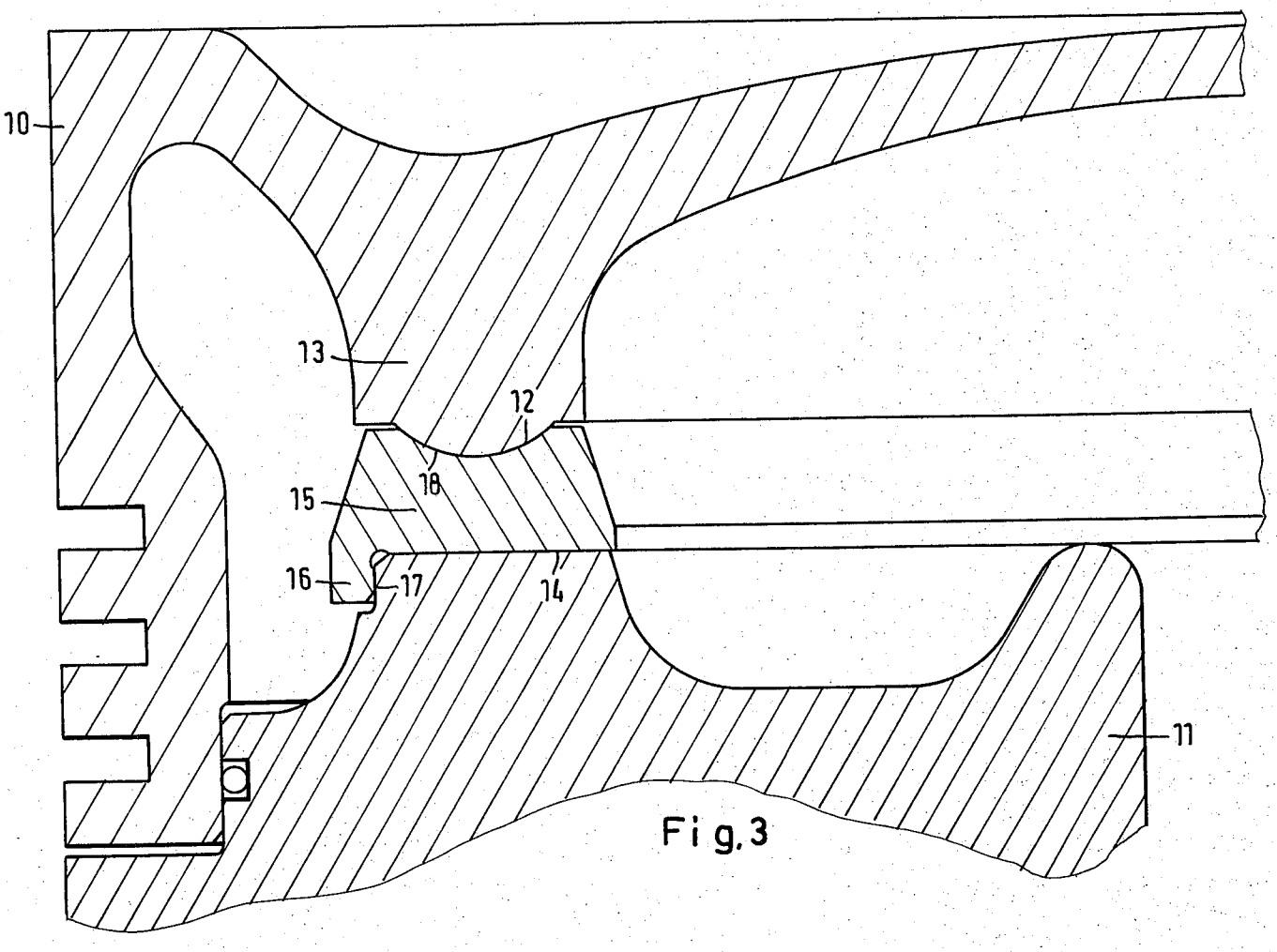
FIG. 3 is another fragmentary longitudinal sectional view showing another embodiment of the piston of the invention.

FIG. 3 is a fragmentary longitudinal sectional view showing the upper portion of another piston of the invention which consists of an upper part 10 of nodular cast iron and a lower part 11 made from an aluminum piston alloy. The trapezoidal steel ring 15 is gripped between the bearing surface 12 of the bearing rib 13 and the bearing surface 14 of the lower part 11. The bearing surface 12 has the shape of a segment of a circle in cross-section. The centering nose 16 provided at the lower outer edge of the ring 15 engages the turned recess 17 of the lower part 11 of the piston. The bearing surface 18 of the gripped ring 15 which faces the bearing surface 17 of the bearing rib 13 has a concavity which conforms to the bearing surface 12, which has the shape of a segment of a circle in cross-section.

Figure 4:
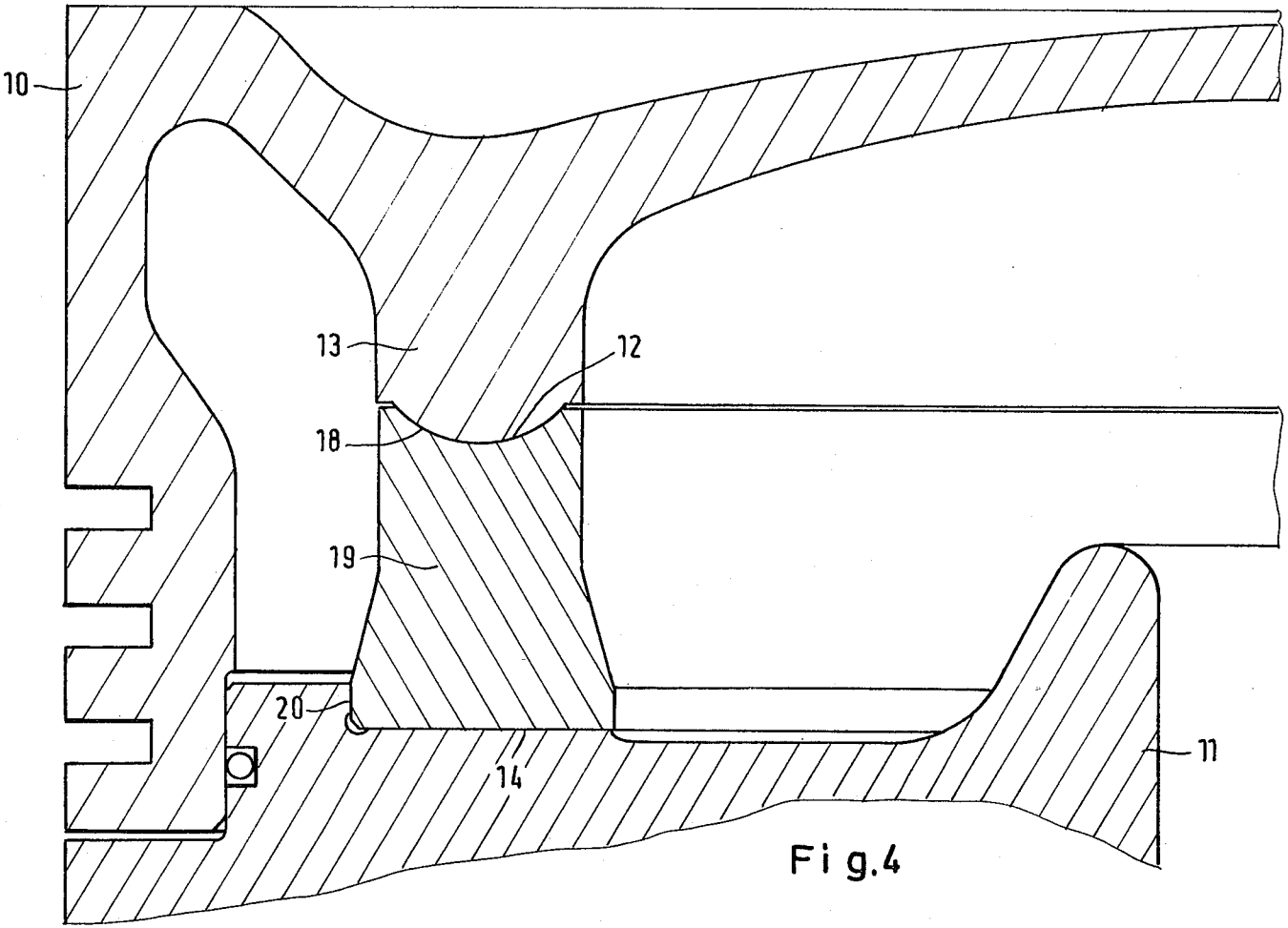
FIG. 4 is a fragmentary longitudinal sectional view similar to FIGS. 1–3 of another piston of the invention.

FIG. 4 is a view similar to FIG. 3 of another piston of the invention which differs from that of FIG. 3 in that the ring 19 gripped between the bearing rib 13 and the lower part 11 is inserted in a turned recess 20 of the lower part 11.

The advantages afforded by the invention reside in that no wear can be detected on the bearing surface of the lower part of the piston even after a relatively long running time of the piston.

What is claimed is:

1. In a liquid-cooled, composite piston for internal-combustion engines, particularly for medium-speed diesel engines, comprising a lower part made of a material comprising an eutectic aluminum-silicon alloy which lower part is connected to an upper part comprised of a ferrous material, said upper part formed on its underside with a concentric rib, which rib faces an opposite top surface of the lower part and is so arranged that the rib constitutes the radially inner boundary of an annular cooling channel, which is disposed in the upper part behind a top land of the piston and behind at least part of a ring-carrying portion of the piston, said rib also defining a central cooling chamber, which is disposed in the upper part and which communicates with the cooling channel by radial coolant bores, the improvement comprising a ring comprised of a ferrous material concentrically disposed and gripped between the surface of said concentric rib and the opposite top surface of the lower part of the piston in an arrangement in which the confronting surfaces of the rib and the gripped ring are in peripheral rolling contact with one another, said ring constituting a portion of the radially inner boundary of said annular cooling channel and a portion of the radially outer boundary of said central cooling chamber.

2. A piston according to claim 1 wherein one of the two confronting surfaces of the rib (4, 13) and the gripped ring (7, 15, 19) is arcuately curved outwardly.

3. A piston according to claim 2 wherein the confronting surface which faces at least one of the outwardly curved confronting surface of the rib (4,13) and the gripped ring (7,15,19) has a corresponding concavity.

4. A piston according to claim 3 wherein the curvatures of the two confronting surfaces differ in size.

5. A piston according to claim 1 wherein at least one of the confronting surfaces of the rib and the gripped ring have been surface-treated by hardening.

6. A piston according to claim 1 wherein the gripped ring is inserted in a concentric turned recess in the lower part (11) of the piston.

7. A piston according to claim 1 wherein the gripped ring is provided at at least one of its inner and outer, lower edge with a peripheral annular centering nose, which engages a concentric turned recess of the lower part of the piston.

8. A piston according to claim 1, wherein at least one of the confronting surfaces of the rib in the gripped ring have been surface treated by chromium-plating.

9. A piston according to claim 1, wherein at least one of the confronting surfaces of the rib and the gripped ring have been surface treated by nitriding.

* * * * *